US006607617B1

(12) United States Patent
Hughes et al.

(10) Patent No.: US 6,607,617 B1
(45) Date of Patent: Aug. 19, 2003

(54) DOUBLE-BASE ROCKET PROPELLANTS, AND ROCKET ASSEMBLIES COMPRISING THE SAME

(75) Inventors: Craig D. Hughes, Salt Lake City, UT (US); Reed J. Blau, Richmond, UT (US)

(73) Assignee: Alliant Techsystems Inc., Edina, MN (US)

( * ) Notice: Subject to any disclaimer, the term of this patent is extended or adjusted under 35 U.S.C. 154(b) by 243 days.

(21) Appl. No.: 09/872,284

(22) Filed: Jun. 1, 2001

Related U.S. Application Data

(60) Provisional application No. 60/225,658, filed on Aug. 16, 2000.

(51) Int. Cl.[7] ..... C06B 45/10
(52) U.S. Cl. ..... 149/19.8; 60/255
(58) Field of Search ..... 60/255; 149/19.8

(56) References Cited

U.S. PATENT DOCUMENTS 3,811,358 A * 5/1974 Morse ..... 86/20 R
3,919,013 A * 11/1975 Fox et al. ..... 149/6
3,924,405 A 12/1975 Cohen et al.
4,072,546 A 2/1978 Winer
4,536,235 A * 8/1985 Lelu et al. ..... 149/19.4
4,696,705 A 9/1987 Hamilton
4,698,106 A 10/1987 Sayles
4,756,251 A 7/1988 Hightower, Jr. et al.
4,798,142 A 1/1989 Canterberry et al.
4,956,029 A 9/1990 Hagel et al.
5,024,160 A 6/1991 Canterberry et al.
5,205,983 A 4/1993 Camp et al.
5,372,664 A 12/1994 Neidert et al.
5,398,612 A * 3/1995 Graham et al. ..... 102/287
5,433,899 A 7/1995 Goetz
5,547,525 A 8/1996 Bennett et al.
5,762,746 A 6/1998 Hartwell et al.
5,867,981 A 2/1999 Lewis

* cited by examiner

*Primary Examiner*—John Hardee
(74) *Attorney, Agent, or Firm*—Parsons Behle & Latimer

(57) ABSTRACT

This rocket motor propellant includes a combustible double-base propellant and non-carbonized, non-graphitized polymeric fibers dispersed in the double-base propellant. The double-base propellant is formed from a composition comprising nitrocellulose and at least one nitrate ester. Representative polymeric fibers include polyethylene, polypropylene, polyesters, polyamides, polyacrylonitriles and combinations thereof.

16 Claims, 1 Drawing Sheet

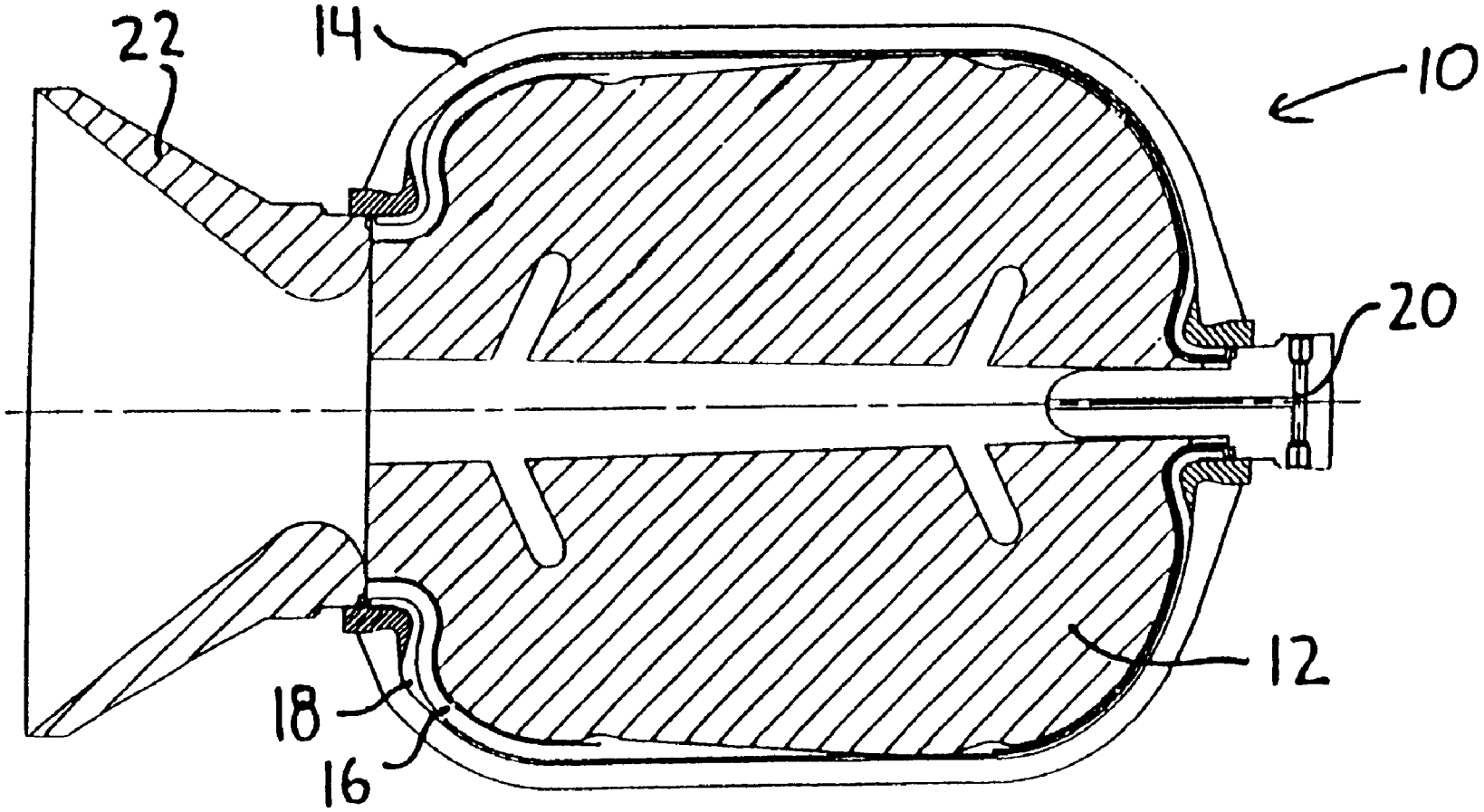
10
20
12
14
16
18
22

DOUBLE-BASE ROCKET PROPELLANTS, AND ROCKET ASSEMBLIES COMPRISING THE SAME

CROSS-REFERENCE TO RELATED APPLICATION

The benefit of priority is claimed based on provisional application Ser. No. 60/225,658 filed in the U.S. Patent & Trademark Office on Aug. 16, 2000.

BACKGROUND OF THE INVENTION

1. Field of the Invention

This invention relates to the double-base propellants and rocket motors containing the same. In a particularly preferred embodiment of the invention, a small tactical rocket motor contains a double-base propellant having improved mechanical properties.

2. Description of the Related Art

Propellants in which the binder is formed from nitrocellulose plasticized with a nitrate ester, such as, for example, nitrocellulose plasticized with nitroglycerine and/or diglycol dinitratei are commonly known as double-base propellants. Due to the combination or inter-diffusion of oxidizing and reducing elements (which release energy through combustion) of the plasticizer and nitrocellulose, double-base propellants are known as homogeneous propellants. Advantageous properties associated with double-base propellants, including their excellent ambient mechanical properties, aging capabilities, and operational characteristics, make double-base propellants highly desirable for many rocket motor applications.

Double-base propellants have consistently been found to be problematic at elevated temperatures due to inferior mechanical properties. For example, double-base propellants are generally understood to exhibit poor high temperature tensile strength and large thermal coefficient of linear expansion (TCLE).

Mechanical strains resulting from dramatic temperature changes, which a propellant experiences in normal fabrication and use, are believed to promote fractures in the propellant grain. Propellants with very high TCLE values may be subject to high mechanical strain as the result of temperature cycling during storage. These fractures can be wide spread and significantly increase the exposed surface area of the propellant that is available for combustion reaction. Further, the amount of fracturing and the vicinities at which the fracturing occur can be unpredictable. As a consequence, the chamber pressure created during combustion of a double-base propellant grain can be increased to unanticipated levels.

To improve the TCLE of double-base propellants and circumvent the problems outlined above, it has been proposed to add solid additives such as aluminum, ammonium perchlorate (AP), or RDX to propellant grains. However, such solid materials may increase the detonation sensitivity of the double-base propellant.

It would therefore be a significant advancement in the art to provide a double-base propellant that is sufficiently mechanically robust, even at elevated temperatures, to avoid unacceptable amounts of propellant grain fracture during use, yet at the same time exhibits a reduced detonation sensitivity to impact, friction, and electrical discharge.

OBJECTS OF THE INVENTION

It is therefore one of the objects of this invention to provide a double-base propellant that may be formulated to address the aforementioned problems associated with the related art and realizes the advancement expressed above.

It is another object of this invention to provide a rocket motor engine or assembly containing the double-base propellant of this invention.

Additional objects and advantages of the invention will be set forth in the description that follows, and in part will be apparent from the description, or may be learned by practice of the invention. The objects and advantages of the invention may be realized and obtained by means of the instrumentalities and combinations pointed out in the appended claims.

SUMMARY OF INVENTION

In accordance one aspect of this invention, these and other objects are attained by the provision of a rocket motor propellant comprising a combustible double-base propellant and non-carbonized, non-graphitized polymeric fibers dispersed in the double-base propellant. The double-base propellant is formed from a composition comprising nitrocellulose and at least one nitrate ester.

The fibers contemplated by this invention are not subject to graphitization or carbonization, except possibly upon ignition of the propellant. When present in an effective concentration, the fibers reduce the friction and impact sensitivity of the propellant, provide mechanical reinforcement, particularly at high temperatures, and eliminate pinch points and areas of high concentration of force.

In accordance with another aspect of this invention, a rocket motor assembly comprising the double-base propellant of this invention is provided. The rocket motor assembly comprises a rocket motor case, a solid propellant grain contained in the rocket motor case, and a nozzle in operative association with the rocket motor case to receive and discharge combustion products generated upon ignition of the solid propellant grain. The solid propellant grain comprises a combustible double-base propellant formed from a composition comprising nitrocellulose and at least one nitrate ester. Polymeric fibers are dispersed in the double-base propellant.

BRIEF DESCRIPTION OF THE DRAWING

The accompanying drawing is incorporated in and constitutes a part of the specification. The drawing, together with the general description given above and the detailed description of the preferred embodiments and methods given below, serve to explain the principles of the invention. In such drawing, there is shown a rocket motor assembly containing a propellant grain in accordance with an embodiment of this invention.

DETAILED DESCRIPTION OF THE PREFERRED METHODS AND EMBODIMENTS OF THE INVENTION

Reference will now be made in detail to the presently preferred embodiments and methods of the invention as described below. It should be noted, however, that the invention in its broader aspects is not limited to the specific details, representative devices and methods, and examples described in this section in connection with the preferred embodiments and methods. The invention according to its various aspects is particularly pointed out and distinctly claimed in the attached claims read in view of this specification, and appropriate equivalents.

It is to be noted that, as used in the specification and the appended claims, the singular forms "a," "an," and "the" include plural referents unless the context clearly dictates otherwise.

As referred to herein, a double-base propellant means a propellant composition derived from a composition comprising one or more energetic polymeric binders and at least one nitrate ester. The most preferred energetic binder is nitrocellulose, which may be used alone or in combination with other energetic or non-energetic binders.

Representative nitrate esters that can be utilized in the double-base propellant composition of the present invention include nitroglycerin (NG), butanetriol trinitrate (BTTN), trimethyol ethane trinitrate (TMETN), diethyleneglycol dinitrate (DEGDN), triethyleneglycol dinitrate (TEGDN), and any combination. Preferably, the nitrate ester plasticizer is BTTN. As used herein and in the appended claims, double-base propellants also encompass propellant composition having other ingredients, such as, by way of example, propellants containing nitroguanidine as an additional energetic ingredient (sometimes referred to as a triple-base propellant), as well as other multi-base propellants.

Representative reinforcing fibers suitable for use in this invention include various known polymeric fibers, including polyethylene, polypropylene, polyesters, polyamides, polyacrylonitriles and combinations thereof. Such fibers are available from commercial sources such as Mini Fibers, Inc. of Johnson City, Tenn. Polyethylene fibers are presently preferred. The fibers are dispersed in, preferably homogeneously dispersed throughout, the propellant prior to casting and curing of the propellant. Dispersion can be attained through conventional propellant mixing cycles. Premixing the fibers with a suitable suspension agent and other solid propellant additives in a high sheer rate blender is a particularly effective method for attaining excellent fiber dispersion. The suspension agent is preferably a liquid that is unable to dissolve or swell the nitrocellulose, yet is readily removable via, for example, evaporation. Such liquids include chloroform, heptanes, hexanes, isopropanol, and/or water. The preferred solvent is heptane.

The concentration of fibers in the propellant can be, by way of example, in a range of from about 0.02 weight percent to about 5 weight percent, and more preferably is in a range of from about 0.1 weight percent to about 2 weight percent, based on the total weight of the propellant.

Preferably, the polymeric fibers have a density substantially similar to the bulk density of the propellant to inhibit aggregation of fibers during premixing. Moreover, fibers that are small in diameter and have large aspect ratios increase the surface area available for intermolecular interactions of the surfaces of the fibers to propellant matrix, thereby improving the mechanical properties of the propellant. Although suitable dimensions for the fibers are not particularly limited, it is preferred that the fibers have a length, on average, in a range of from 0.05 mm to about 3 mm and an average diameter in a range of from 2 $\mu$m to 40 $\mu$m, and an average aspect ratio in a range of from 20 to 200.

The inventive composition can additionally comprise high surface area carbon black, wherein high surface area refers to carbon black with a surface area greater than or equal to about 25 $m^2/g$. Preferably, weight ratio of the carbon black to the burn rate modifier is in a range of from 1:2 to 1:7, most preferably at a ratio of 1:3. Burn rate modifiers include one or a combination of $Pb_3O_4$, triphenylbismuth, carboxylate, or aryloxide salts of copper and/or lead. These ballistic modifiers can be present in the double-base propellants in concentrations in a range of from about 1 weight percent to about 5 weight percent. One or a combination of "non-energetic" plasticizers, such as triacetin, di-n-propyl adipate, diethylphthalate can be added to the propellant in a range of between 2 weight percent to 11 weight percent. One or a combination of stabilizers such as N-methyl-p-nitroaniline, or 2-nitrodiphenylamine can be added to the propellant, suitably in a range of from 1 weight percent to 2 weight percent. A curative for crosslinking the nitrocellulose can also optionally be included. Representative curatives include biuret triisocyanate desmodour (N-100), which can suitably be added at a concentration of less than about 1 weight percent.

An example of a rocket motor assembly suitable for use with the double-base propellant of this invention is shown in the accompanying FIGURE, in which the rocket motor assembly is generally designated by reference numeral 10. The assembly 10 includes a solid propellant grain 12 loaded within the interior surface of the rocket motor case 14. Typically, insulation 16 and a liner 18 are interposed between the case 14 and the solid propellant grain 12. The insulation 16 and the liner 18 serve to protect the case from the extreme conditions produced during combustion of the solid propellant grain 12. Methods for loading a rocket motor case 14 with the insulation 16, the liner 18, and the solid propellant grain 12 are known to those skilled in the art, and can be readily adapted without undue experimentation to incorporate the propellant of this invention. Liner compositions and methods for applying liners into a rocket motor case are also Well known in the art. Also shown in the FIGURE is an igniter 20 attached to the forward end of the case 14 for igniting the solid propellant grain 12 and a nozzle assembly 22 attached at the aft end of the case 14 for expelling at high velocities combustion products generated during burning of the solid propellant grain 12.

The outer case structure 14 may be formed from any material commonly used for rocket motor applications, such as composite, metal, or alloy materials. Chemorheologically viscosity tailored matrix resin formulations for making composite casings are disclosed in U.S. Pat. Nos. 5,011,721, 5,356,499, 5,545,278, and 5,593,770.

In a particularly preferred embodiment of this invention, the double-base propellant is used in a 2.75 inch rocket motor assembly.

The following examples are offered to further illustrate the synthesis methods of the present invention. The examples are intended to be exemplary and should not be viewed as exhaustive of the scope of the invention.

EXAMPLES

Examples 1–3 and Comparative Example A

For each of Examples 1–3, a propellant was prepared from the ingredients set forth in TABLE 1:

TABLE 1

| Ingredient | Parts of weight |
|---|---|
| Plastisol Nitrocellulose (PNC; $C_6H_{7.55}N_{2.45}O_{9.90}$) | 33.1 |
| Butanetriol Trinitrate (BTTN; $C_4H_7N_3O_9$) | 61.20 |
| N-Methyl-p-nitroaniline (MNA; $C_7H_8N_2O_2$) | 1.20 |
| Triacetin (Glycerol Triacetate; $C_9H_{14}O_6$) | 2.75 |
| Ballistic Additives | 1.00 |
| Polymeric Fibers | 0.50 |
| Biuret triisocyanate desmodour curative (N-100; $C_{23}H_{38}N_6O_5$) | 0.30 |

The formulation was prepared in a batch mixer by the following procedure. First, the ballistic additives, such as described above, fibers, triacetin and chloroform were blended in a high speed blender for 10 minutes. (The particular polymeric fibers used for each example are set forth in Table 2.) Second, MNA was dissolved in BTTN at 150° F. (about 65° C.) with medium speed mixing, and then the mixture of ballistic additive/fibers/triacetin was added to the MNA/BTTN mixture. The temperature was reduced to 80° F. (about 27° C.), at which point the PNC was added. Next, the temperature was raised to 120° F. (about 49° C.) for mixing. The curative was then added while mixing under vacuum until the propellant composition reached a desired viscosity, at which point the propellant composition was cast and cured.

The same propellant formulation and procedure were followed for Comparative Example A, except that no fibers were added to the propellant formulation.

The cured propellant formulations were tested for stress, strain, modulus, and thermal coefficient of linear expansion (TCLE) using standard mechanical testing techniques commonly known to those of ordinary skill in the practice of testing the mechanical properties of propellants. The samples were tested at room temperatures (75° F.; about 24° C.) with a crosshead speed of 2 inches (5.08 cm) per minute. The test results are set forth in Table 2:

TABLE 2

| Example | Fiber Type | Average dimensions | Modulus | Stress (psi) | Strain (%) | TCLE (ppm/° F.) |
|---|---|---|---|---|---|---|
| 1 | Polyethylene | 5 μm diameter and 0.1 mm length | 597 | 446 | 143 | 111 |
| 2 | Nylon | 3.9 denier and 0.125 inch length | 383 | 355 | 141 | 75 |
| 3 | Polyester | 6.0 denier and 0.125 length | 396 | 333 | 144 | 121 |
| A | none | — | 208 | 242 | 146 | 153 |

As evident from Table 2, the largest stress and strain values obtained were for Example 1 containing the polyethylene fibers. Example 1 exhibited a 27% reduction in TCLE compared to comparative example A. The formulation of Example 1 was next tested for mechanical properties over a wide temperature range. The low temperature (−45° F.) samples were tested at a crosshead speed of 20 inches (50.8 cm) per minute to evaluate propellant behavior under high strain ignition conditions. Room temperature (75° F.) samples were tested at a crosshead speed of 2 inches (5.08 cm) per minute. High temperature (145° F.) samples were tested at a crosshead speed of 0.02 inches (0.508 mm) per minute to evaluate the strain capability of the propellant. Comparative Example A was subjected to the same testing. The results are set forth in Table 3 below:

TABLE 3

| Example | Temperature (° F.) | Modulus | Stress (psi) | Stress corr. (psi) | Strain (%) | Strain, fail (%) |
|---|---|---|---|---|---|---|
| 1 | −45 | 57,423 | 4241 | 4469 | 5 | 5 |
| | 75 | 597 | 446 | 1081 | 143 | 149 |
| | 145 | 119 | 128 | 392 | 204 | 208 |
| A | −45 | 40,312 | 2935 | 3287 | 12 | 12 |
| | 75 | 208 | 242 | 594 | 146 | 149 |
| | 145 | 63 | 71 | 153 | 116 | 118 |

The addition of 0.5% polyethylene fibers in Example 1 improved the high temperature tensile strength and strain by 150% and 75%, respectively, over comprative example A. In addition, low temperature tensile strength was increased by 36%. These are dramatic improvements, which were unexpected, especially considering the low concentration of fibers added. Furthermore, the presence of the polyethylene fibers did not adversely affect the detonability of the propellant.

The foregoing detailed description of the preferred embodiments of the invention has been provided for the purposes of illustration and description, and is not intended to be exustive or to limit the invention to the precise embodiments disclosed. The embodiments were chosen and described in order to best explain the principles of the invention and its practical application, thereby enabling others skilled in the art to understand the invention for various embodiments and with various modifications as are suited to the particular use contemplated. It is intended that the scope of the invention cover various modifications and equivalents included within the spirit and scope of the appended claims.

We claim:

1. A rocket motor propellant comprising:

a combustible double-base propellant formed from a composition comprising nitrocellulose and at least one nitrate ester; and non-carbonized, non-graphitized polymeric fibers dispersed in the double-base propellant.

2. A rocket motor propellant according to claim 1, wherein the polymeric fibers comprise at least one member selected from the group consisting of polyethylene, polypropylene, polyester, polyamide, and polyacrylonitrile fibers.

3. A rocket motor propellant according to claim 1, wherein the polymeric fibers comprise polyethylene.

4. A rocket motor propellant according to claim 1, wherein the polymeric fibers have an average length in the range of from about 0.05 mm to about 3 mm and average diameters in the range of from about 2 μm to about 40 μm.

5. A rocket motor propellant according to claim 1, wherein the polymeric fibers are present in the propellant in a range of about 0.02 weight percent to about 5 weight percent, based on the total weight of the propellant.

6. A rocket motor propellant according to claim 1, wherein the polymeric fibers are present in the propellant in a range of about 0.1 weight percent to about 2 weight percent, based on the total weight of the propellant.

7. A rocket motor propellant according to claim 1, wherein the nitrate ester comprises at least one member selected from the group consisting of nitroglycerin, butanetriol trinitrate, trimethyol ethane trinitrate, diethyleneglycol dinitrate, and triethyleneglycol dinitrate.

8. A rocket motor propellant according to claim 1, wherein the nitrate ester comprises butanetriol trinitrate.

9. A rocket motor assembly comprising a rocket motor case, a solid propellant grain contained in the rocket motor case, and a nozzle in operative association with the rocket motor case to receive and discharge combustion products generated upon ignition of the solid propellant grain, the solid propellant grain comprising:

a combustible double-base propellant formed from a composition comprising nitrocellulose and at least one nitrate ester; and non-carbonized, non-graphitized polymeric fibers dispersed in the double-base propellant.

10. A rocket motor assembly according to claim 9, wherein the polymeric fibers comprise at least one member selected from the group consisting of polyethylene, polypropylene, polyester, polyamide, and polyacrylonitrile fibers.

11. A rocket motor assembly according to claim 9, wherein the polymeric fibers comprise polyethylene.

12. A rocket motor assembly according to claim 9, wherein the polymeric fibers have an average length in the range of from about 0.05 mm to about 3 mm and average diameters in the range of from about 2 $\mu$m to about 40 $\mu$m.

13. A rocket motor assembly according to claim 9, wherein the polymeric fibers are present in the solid propellant grain in a range of about 0.02 weight percent to about 5 weight percent, based on the total weight of the solid propellant grain.

14. A rocket motor assembly according to claim 9, wherein the polymeric fibers are present in the solid propellant grain in a range of about 0.1 weight percent to about 2 weight percent, based on the total weight of the solid propellant grain.

15. A rocket motor assembly according to claim 9, wherein the nitrate ester comprises at least one member selected from the group consisting of nitroglycerin, butanetriol trinitrate, trimethyol ethane trinitrate, diethyleneglycol dinitrate, and triethyleneglycol dinitrate.

16. A rocket motor assembly according to claim 9, wherein the nitrate ester comprises butanetriol trinitrate.

* * * * *